US008939104B2

(12) United States Patent
Holesz

(10) Patent No.: US 8,939,104 B2
(45) Date of Patent: Jan. 27, 2015

(54) LATERAL THRUSTER FOR A VESSEL

(75) Inventor: Hubert Holesz, Hohenems (AT)

(73) Assignee: Sleipner—Marinno GmbH, Rankweil (AT)

( * ) Notice: Subject to any disclaimer, the term of this patent is extended or adjusted under 35 U.S.C. 154(b) by 888 days.

(21) Appl. No.: 13/129,475

(22) PCT Filed: Nov. 12, 2009 (Under 37 CFR 1.47)

(86) PCT No.: PCT/AT2009/000433

§ 371 (c)(1), (2), (4) Date: Dec. 13, 2011

(87) PCT Pub. No.: WO2010/054418

PCT Pub. Date: May 20, 2010

(65) Prior Publication Data

US 2012/0251353 A1 Oct. 4, 2012

(30) Foreign Application Priority Data

Nov. 17, 2008 (AT) ..... 1783/2008

(51) Int. Cl.

| | |
|---|---|
| ***B63H 5/07*** | (2006.01) |
| ***B63H 21/17*** | (2006.01) |
| ***B63H 25/42*** | (2006.01) |
| ***B63H 5/125*** | (2006.01) |

(52) U.S. Cl.

CPC ..... *B63H 5/125* (2013.01); *B63H 2005/1254* (2013.01); *B63H 2005/1258* (2013.01)

USPC ..... 114/151; 114/144 R; 114/148; 440/6

(58) Field of Classification Search

USPC ..... 114/144 R, 146, 148, 150, 151, 322, 114/330, 331, 337, 338; 440/6; 60/221, 222

See application file for complete search history.

(56) References Cited

U.S. PATENT DOCUMENTS

| | | | | | |
|---|---|---|---|---|---|
| 3,251,330 | A | | 5/1966 | Honegger | |
| 3,280,501 | A | | 10/1966 | Hornbostel | |
| 3,521,589 | A | * | 7/1970 | Kemp | 114/330 |
| 3,702,597 | A | * | 11/1972 | Odum et al. | 405/188 |
| 4,208,978 | A | | 6/1980 | Eller | |
| 4,223,625 | A | | 9/1980 | Puretic | |
| 4,529,386 | A | | 7/1985 | Smith | |
| 4,732,104 | A | | 3/1988 | Roestenberg | |
| 4,843,575 | A | | 6/1989 | Crane | |
| 5,016,553 | A | * | 5/1991 | Spencer | 114/151 |
| 5,152,240 | A | | 10/1992 | Fontanille | |
| 5,246,393 | A | | 9/1993 | von der Stein | |
| 5,450,321 | A | | 9/1995 | Crane | |
| 5,725,402 | A | | 3/1998 | Marsh | |
| 5,995,903 | A | | 11/1999 | Smith et al. | |

(Continued)

FOREIGN PATENT DOCUMENTS

| | | | | | |
|---|---|---|---|---|---|
| CN | 1960909 | | | 5/2007 | |
| DE | 3001701 | | | 7/1981 | |
| EP | 0566788 | | | 10/1993 | |
| EP | 0716977 | | | 6/1996 | |
| FR | 2810012 | | | 12/2001 | |
| FR | 2810012 | A1 | | 12/2001 | |
| GB | 2080209 | A | | 2/1982 | |
| JP | 55044033 | | | 3/1980 | |
| JP | 6364599 | | | 4/1988 | |
| JP | 08198186 | | | 8/1996 | |
| JP | 08337198 | A | * | 12/1996 | B63H 25/42 |
| JP | 2007230547 | A | * | 9/2007 | |
| WO | 03047966 | A2 | | 6/2003 | |
| WO | 2004067379 | A1 | | 8/2004 | |
| WO | 2005087584 | | | 9/2005 | |
| WO | 2008108664 | A1 | | 9/2008 | |

*Primary Examiner* — Ajay Vasudeva

(74) *Attorney, Agent, or Firm* — Volpe and Koenig, P.C.

(57) ABSTRACT

A lateral thruster for a vessel with a housing (1), at least one electric motor (2, 2') fitted in the housing (1) and at least one transverse propeller (13) acting transversely with respect to a longitudinal axis (3) of the vessel (5) is additionally provided with at least one longitudinal propeller (21) acting in a direction of the longitudinal axis (3) of the vessel (5).

8 Claims, 3 Drawing Sheets

(56) References Cited

U.S. PATENT DOCUMENTS

| | | | | |
|---|---|---|---|---|
| 6,244,912 | B1 | 6/2001 | Quadrini et al. | |
| 6,264,513 | B1 | 7/2001 | Marsh | |
| 6,308,649 | B1 | 10/2001 | Gedeon | |
| 6,655,309 | B1 | 12/2003 | Stephens | |
| 6,665,309 | B2 | 12/2003 | Hsu et al. | |
| 6,865,997 | B2 | 3/2005 | Stephens | |
| 7,452,253 | B2 * | 11/2008 | Levander et al. | 440/53 |
| 8,051,792 | B2 * | 11/2011 | Mochizuki | 114/271 |
| 2001/0029133 | A1 | 10/2001 | Van Breems | |
| 2003/0191562 | A1 | 10/2003 | Robertson et al. | |
| 2004/0147182 | A1 | 7/2004 | Reuter et al. | |

* cited by examiner

LATERAL THRUSTER FOR A VESSEL

BACKGROUND

The invention relates to a lateral thruster for a vessel with a housing, at least one electric motor mounted in the housing, and at least one transverse propeller acting transverse to the longitudinal axis of the vessel.

Lateral thrusters for supporting the maneuvering of a ship with a propeller acting transverse to the longitudinal axis of the ship are also called lateral thrust control systems. For the most prevalent arrangement in the area of the bow, the designation bow thruster is also typical.

In a conventional construction of a bow thruster, in the front tenth of the ship, a tubular passage is constructed through the entire width of the ship. In this tubular passage, a propeller (impeller) is arranged that allows the bow of the ship to move to port or starboard, wherein the rotational direction of the propeller is adapted accordingly. The propeller is driven by an electric or hydraulic motor installed in the ship.

Lateral thrusters without a tubular construction through the ship are known, for example, from EP 0 716 977 A1 and US 2001/0029133 A1, wherein the propeller is arranged in the water external to the ship, but the motor lies in the interior of the boat. U.S. Pat. Nos. 5,152,240 and 4,529,386 describe lateral thrusters that are arranged completely in the interior of the boat and can be extended from the bow or inserted back into the bow after opening a flap located in the hull.

From U.S. Pat. No. 4,732,104, DE 3 001 701 A1, U.S. Pat. Nos. 4,208,978, 4,223,625, lateral thrusters are disclosed that are mounted on the bow and are arranged, when not in use, above the water. By means of different devices, e.g., by manual pivoting about a horizontal axis, the lateral thrusters can be lowered below the water level.

From FR 2 810 012 A1, a lateral thruster is disclosed that is mounted laterally on the side of the vessel so that it is removable outside of the ship and its motor and propeller are located in a housing under water during operation.

In the lateral thruster known from WO 2005/087584 A1, the housing of the lateral thruster is mounted on the hull of the ship in a stationary arrangement external to the ship. The at least one propeller acting transverse to the longitudinal axis of the vessel and the at least one electric motor provided for driving the propeller or propellers are arranged in this housing.

A ship propulsion system is further disclosed from EP 0 566 788 that has a propeller driven by an electric motor and can be mounted outside on the body of the ship.

SUMMARY

The objective of the invention is to expand the possible uses of a lateral thruster of the type noted above. This is possible by a device according to the invention.

The device of the invention has, in addition to the at least one transverse propeller acting transverse to the longitudinal axis of the vessel, at least one longitudinal propeller acting in the longitudinal direction of the vessel. In one embodiment of the invention, the longitudinal propeller could be driven by the same electric motor as the transverse propeller, wherein the transverse propeller and the longitudinal propeller can each be connected to and separated from the electric motor by means of a coupling. In another embodiment, the transverse propeller and the longitudinal propeller can each be driven by a separate electric motor, wherein both the electric motor used for driving the transverse propeller and also the electric motor used for driving the longitudinal propeller are arranged in a common housing. In principle, it is also conceivable and possible to provide more than one transverse propeller, wherein the transverse propellers could be driven by the same electric motor or by separate electric motors. In principle, it is further conceivable and possible to provide more than one longitudinal propeller, wherein the longitudinal propeller can be driven by the same electric motors or by separate electric motors.

Through a device according to the invention, the possible maneuvers of the ship can be significantly expanded, especially in connection with the casting off and docking of the ship. Motor-driven main drives of motor ships are usually constructed in the form of internal combustion engines. Such an internal combustion engine requires a certain minimum rotational speed at which a relatively large thrust is still generated, so that the maneuvering of the ship with the main drive is very difficult. By fitting the ship with a device according to the invention, the main drive could be completely shut down for maneuvering the ship and the ship could be maneuvered only with the device according to the invention. With the longitudinal propeller, the velocity of the ship in the direction of its longitudinal axis can be influenced—forward or backward—wherein the ship can be accelerated or also slowed down. With the help of the transverse propeller, the direction of the longitudinal axis of the ship can be changed. The device according to the invention thus represents a lateral thruster with integrated auxiliary drive.

If there is an additional lateral thruster at the other end of the ship, then a parallel displacement of the ship could also be performed.

A device according to the invention could be used in an especially advantageous way for ships with a length in the range of 7 m to 20 m.

A device according to the invention can be used advantageously both for motorboats and also sailing boats.

The weight of the ship that is equipped with a device according to the invention preferably lies in the range of 1.5 t to 18 t.

Advantageously, the housing of the device according to the invention is mounted on the hull of the ship in a stationary arrangement external to the ship. To this end, the housing has a connection flange by which it can be mounted on the hull of the ship in a stationary arrangement external to the ship.

Through the arrangement of the at least one electric motor in the housing arranged external to the ship, the electric motor can be cooled by water. This arrangement achieves a simple and effective cooling of the at least one electric motor.

The longitudinal propeller could also be used preferably for providing a power source. For example, for longer trips with sailing ships, an adequate power supply is typically problematic. Through the movement of the ship through the water—carried out, e.g., by wind propulsion—the longitudinal propeller could be driven by this movement and could drive the relevant electric motor or motors that now acts or act as generators.

For reducing the water resistance while moving, when the longitudinal propeller is not needed, the longitudinal propeller could be constructed as a controllable pitch propeller. Controllable pitch propellers are known.

BRIEF DESCRIPTION OF THE DRAWINGS

Additional advantages and details of the invention will be explained below with reference to the accompanying drawing. Shown herein are.

DETAILED DESCRIPTION OF THE PREFERRED EMBODIMENTS

Figure 1:
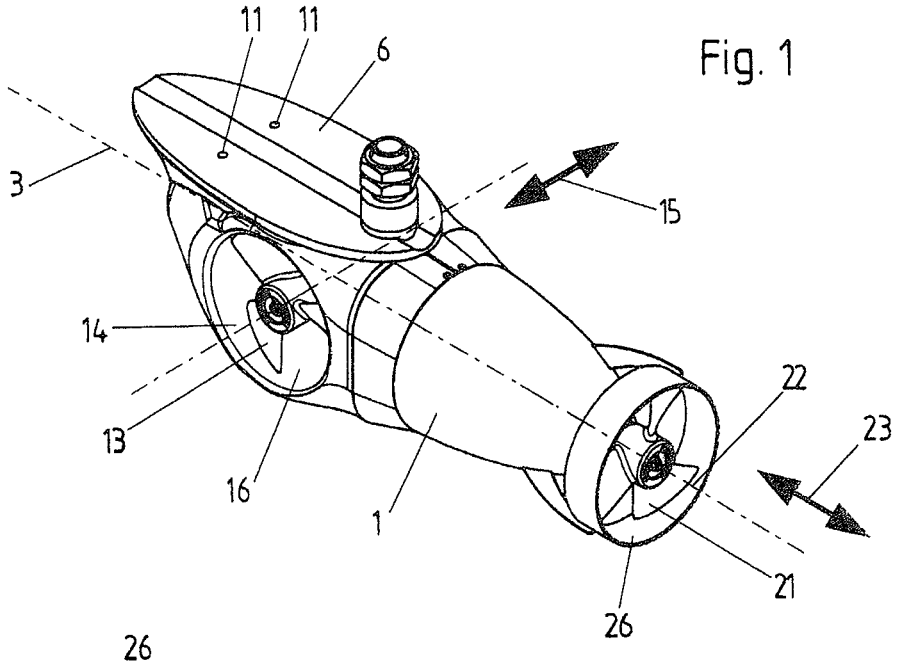
FIG. 1 is a perspective view of a device according to the invention.

An embodiment of a device according to the invention is shown in FIGS. 1 to 5. The device comprises a housing 1 with an electric motor 2 arranged therein. The housing 1 has a longitudinal axis that is to be aligned in the mounted state of the device parallel to the longitudinal axis 3 of the vessel. Preferably, the housing 1 has a streamlined shape, in order to minimize water resistance.

For mounting the housing 1 on the hull 4 of the vessel 5 (cf. FIG. 7), a connection flange 6 of the housing 1 is used that contacts the hull 4 in the mounted state. The mounting is realized by a first threaded bolt 7 that is mounted on the connection flange 6, for example, by welding or screwing. The threaded bolt 7 has a hollow construction, so that the supply and control lines of the device can be fed through this bolt. A seal 8 is used for sealing against the hole through the hull 4. Nuts 9, 10 for fastening are likewise shown. In addition to this main mounting, advantageously additional mountings are performed, for which purpose, drill holes 11, 12 are provided through the connection flange 6, through which, e.g., screws can be screwed into the hull 4.

A transverse propeller 13 can be driven by the electric motor 2, wherein the axis 14 of this transverse propeller is transverse, in particular, at a right angle, to the longitudinal axis of the housing 1 or to the longitudinal axis 3 of the vessel 5 and thus acts in the transverse direction 15 that is shown in FIG. 1 by a double-headed arrow.

The transverse propeller 13 is arranged in a passage channel 16 running parallel to its axis 14 through the housing; thus it represents an impeller or ducted fan.

The shaft 17 of the transverse propeller 13 is supported, so that it can rotate, by a part 18 fixed to the housing (cf. FIGS. 2 and 3) (the part 18 could be part of the housing 1 or could be connected rigidly to this housing). Thus the transverse propeller 13 is supported by the housing 1.

The axis of the electric motor 2 lies parallel to the longitudinal axis 3 of the vessel 5 or the housing 1, i.e., the electric motor 2 is installed in the housing 1 fore and aft. The longitudinal axis of the electric motor 2 extends at a right angle to the axis 14 of the transverse propeller 13. The force transmission is realized by an angular gear 19 that is formed, in particular, by a bevel gear pair.

Between the electric motor 2 and the transverse propeller 13 there is a coupling 20 whose function will be explained farther below. The coupling 20 could be constructed in the form of an electromagnetic coupling.

Figure 4:
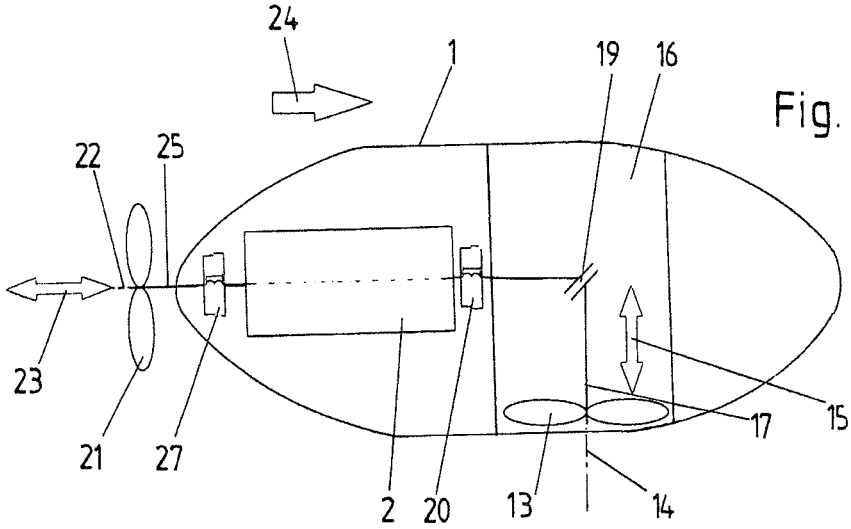
FIG. 4 is a schematic diagram of the device.

Furthermore, a longitudinal propeller 21 can be driven by the electric motor 2, wherein the axis 22 of this longitudinal propeller lies parallel to the longitudinal axis of the housing 1 or parallel to the longitudinal axis 3 of the vessel 5. The longitudinal propeller 21 thus acts in the longitudinal direction 23 that is shown in FIG. 4 by a double-headed arrow. The longitudinal direction 23 lies parallel to a direction of primary movement 24 (forward straight ahead) of the vessel.

The shaft 25 of the longitudinal propeller 21 is supported, so that it can rotate, by the housing 1 or a part connected rigidly to this housing. The longitudinal propeller 21 is thus supported by the housing 1.

Figure 2:
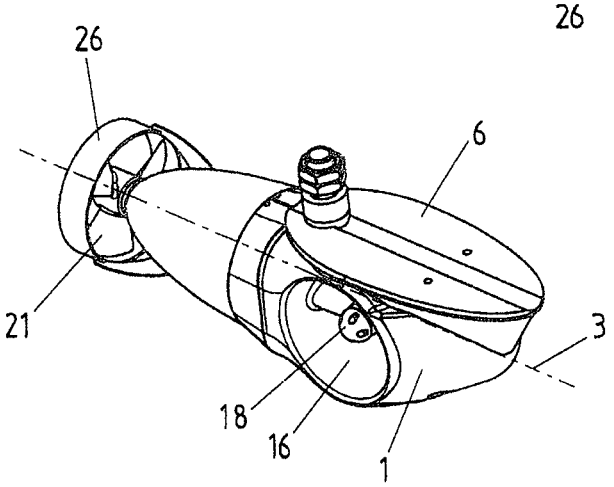
FIG. 2 is a perspective view of the device from FIG. 1 from a different viewing direction.
Figure 3:
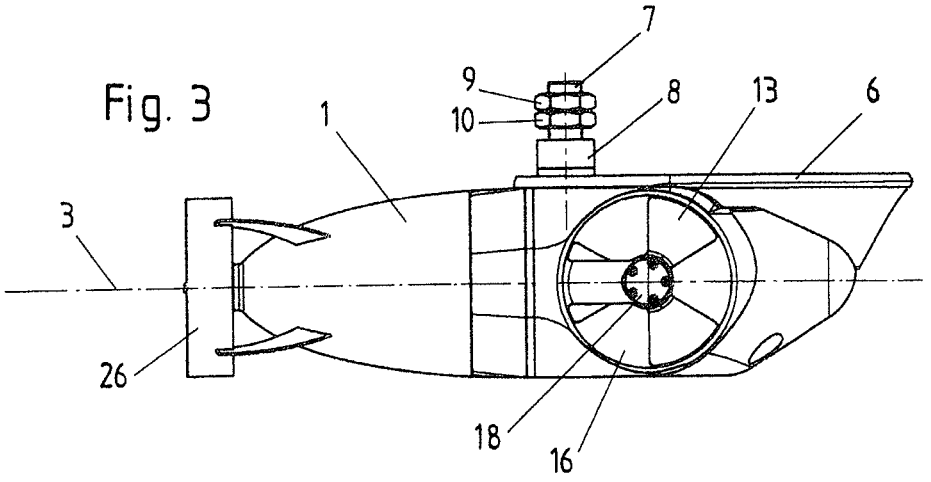
FIG. 3 is a side view.

In the embodiment as shown in FIGS. 1 to 3, the longitudinal propeller 21 is surrounded by a ring-shaped casing 26 that is mounted on the housing 1. The longitudinal propeller is constructed in this way as an impeller or ducted fan.

The longitudinal propeller 21 is connected to the electric motor 2 by a coupling 27 whose function is explained below. The coupling 27 is advantageously constructed in the form of an electromagnetic coupling.

If the coupling 20 is closed and the coupling 27 is opened, then the transverse propeller 13 is driven by the electric motor 2 and the device acts conventionally as a lateral thruster. According to the rotational direction of the electric motor 2, a thrust can be generated in the direction of starboard or port.

If the coupling 20 is opened and the coupling 27 is closed, then the longitudinal propeller 21 is driven by the electric motor 2. The device now acts an auxiliary drive, wherein according to the rotational direction of the electric motor, a thrust can be generated toward the bow or stern.

Figure 7:
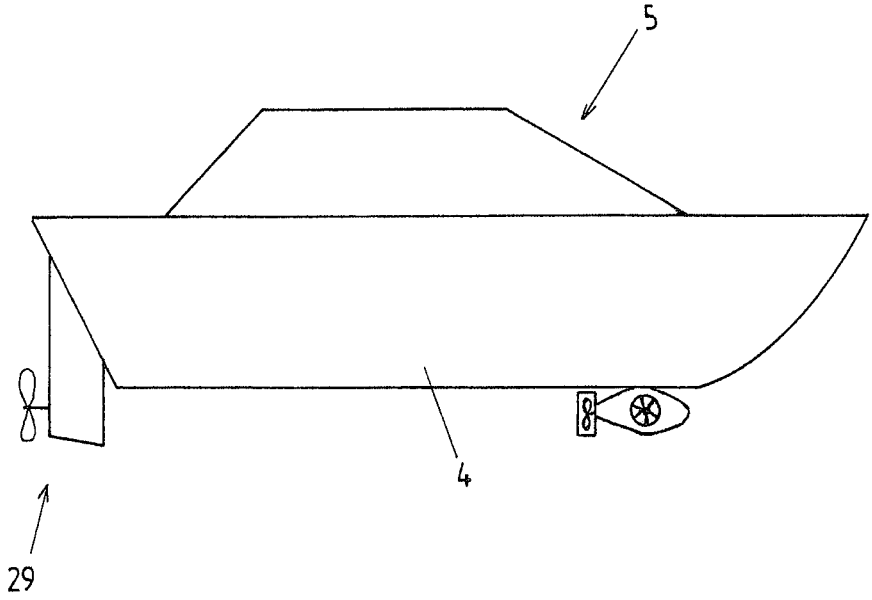
FIG. 7 is a schematic diagram of a ship with a device according to the invention mounted on the ship.

FIG. 7 shows a schematic diagram of a vessel 5 equipped with a device according to the invention. The device according to the invention is here mounted in a stationary arrangement on the hull 4 in the region of the bow external to the ship. In the region of the stern, there is a main motor drive 29 for driving the vessel at the traveling speed. The main drive 29 could have, in particular, an internal combustion engine.

An assembly of the device according to the invention in the region of the stern is also conceivable and possible.

The device could be used for maneuvering with the main drive of the vessel 5 shut down or at least for assisting the maneuvering at low speeds (below 5 knots).

In the vicinity of a docking or casting-off location, the main drive can be shut down and the vessel 5 can be moved forward and controlled with fine movements only with the device according to the invention. With the longitudinal propeller 21, the vessel can be moved not only forward or backward, but can also slow down a movement of the vessel in the longitudinal direction 23 when it has a speed that is too high or when the vessel is being pushed by wind pressure. With the transverse propeller 13, for an assembly of the device in the bow region or for an assembly in the stern region, the bow or stern of the vessel 5, respectively, are moved to starboard or port.

In this embodiment, the transverse propeller 13 and the longitudinal propeller 21 are driven by the electric motor alternately (sequentially). Thus, at most one of the couplings 20, 27 is closed at the same time.

Figure 5:
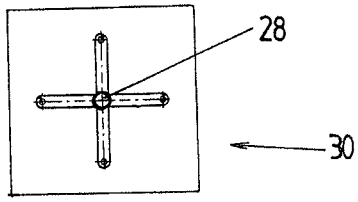
FIG. 5 is a schematic diagram of an operating and control unit of the device.

A corresponding operating and control unit 30 for the lateral thruster with auxiliary drive is shown schematically in FIG. 5. A control stick 28 can be moved, starting from a home position, in four directions standing perpendicular to each other. Two opposite directions are used for controlling the function of the lateral thruster, that is, for controlling the transverse propeller 13 (thrust direction starboard and port) and two opposite directions standing perpendicular hereto are used for controlling the auxiliary drive of the longitudinal propeller 21 (thrust direction bow and stern).

Figure 6:
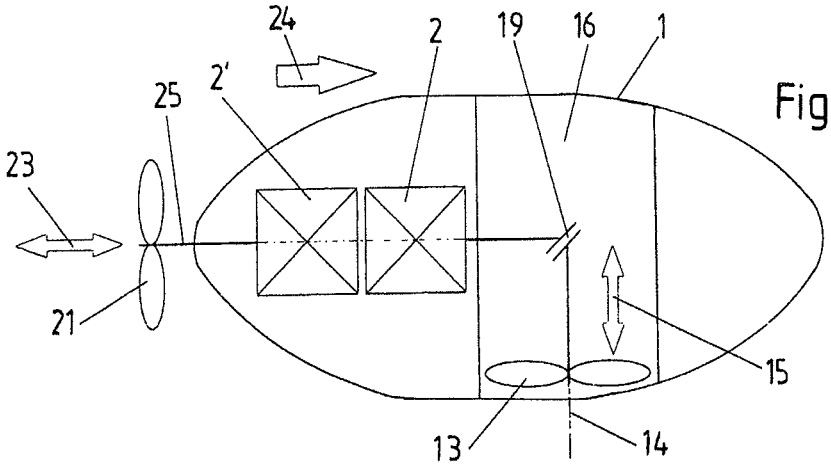
FIG. 6 is a block diagram according to FIG. 4 of a modified embodiment.

One modified embodiment of the invention is shown in FIG. 6. There are the following differences with the previously described embodiment: for driving the transverse propeller 13 and for driving the longitudinal propeller 21, separate electric motors 2, 2' are provided here. Couplings between the electric motor 2 for driving the transverse propeller 13 and the transverse propeller 13 or between the electric motor 2' for driving the longitudinal propeller 21 and the longitudinal propeller 21 can be eliminated here.

Both electric motors 2, 2' are advantageously installed in the housing 1 fore and aft, thus, their axes lie parallel to the longitudinal axis of the housing 1.

The drive of the propellers 13, 21 could be realized as described before alternately (sequentially). To this end, an operating and control unit could be provided analogous to FIG. 5. For this embodiment, in a simple way, an additional parallel control is also possible. To this end, an operating and control unit could be provided in which the control stick 28 can be moved, starting from its home position, in all directions, like a joystick. The functions of the lateral thruster and the auxiliary drive thus could be carried out not only sequentially but also simultaneously.

For planing hulls (motor boats), the bow lifts out of the water during travel and the device according to the invention according to one of the described embodiments is located outside of the water flow. During a slow harbor maneuver, it is completely functional.

The size of the device according to the invention can be adapted to any boat size, from larger skiffs to medium-size planing hulls (motor boats) and displacement hulls (sailing ships).

For driving the transverse propeller, more than one electric motor 2 could also be provided, for example, two electric motors in line fore and aft, with these motors being located on both sides of the passage channel 16.

It is conceivable and possible to provide more than one transverse propeller 13 and/or more than one longitudinal propeller 21, which are driven by a shared or by multiple electric motors.

In order to turn the rotational direction of each propeller 13, 21, in principle it would also be conceivable and possible to provide a corresponding reversing gear instead of reversing the rotational direction of the associated electric motor 2, 2'.

Legend To The Reference Symbols:

1 Housing
2, 2' Electric motor
3 Longitudinal axis
4 Hull
5 Vessel
6 Connection flange
7 Threaded bolt
8 Seal
9 Nut
10 Nut
11 Drill hole
12 Drill hole
13 Transverse propeller
14 Axis
15 Transverse direction
16 Passage channel
17 Shaft
18 Part
19 Angular gear
20 Coupling
21 Longitudinal propeller
22 Axis
23 Longitudinal direction
24 Direction of primary movement
25 Shaft
26 Casing
27 Coupling
28 Control stick
29 Main drive
30 Operating and control unit

The invention claimed is:

1. A lateral thruster for a vessel comprising a housing, at least one electric motor mounted in the housing, and at least one transverse propeller acting transverse to a longitudinal axis of the vessel, the lateral thruster also includes at least one longitudinal propeller acting in a direction of the longitudinal axis of the vessel, and the longitudinal propeller is driven by the same electric motor as the transverse propeller, wherein the transverse and the longitudinal propellers are each connected to the electric motor and arranged to be separated from the electric motor by a respective coupling.

2. The lateral thruster according to claim 1, wherein there are at least two of the electric motors and the transverse propeller and the longitudinal propeller are each driven by separate ones of the electric motors, respectively, wherein both the electric motor for driving the transverse propeller and also the electric motor for driving the longitudinal propeller are arranged in the housing.

3. The lateral thruster according to claim 1, wherein the transverse propeller is supported by the housing.

4. The lateral thruster according to claim 1, wherein the transverse propeller is arranged in a passage channel extending through the housing and transverse to the longitudinal axis of the vessel.

5. The lateral thruster according to claim 1, wherein the longitudinal propeller is supported by the housing.

6. The lateral thruster according to claim 5, wherein a shaft on which the longitudinal propeller is arranged is supported so that the shaft can rotate in the housing or in a part connected rigidly to the housing.

7. The lateral thruster according to claim 1, wherein a ring-shaped casing surrounding the longitudinal propeller is mounted on the housing.

8. The lateral thruster according to claim 1, wherein the housing is mounted on a hull in a stationary arrangement external to the vessel.

* * * * *